US009939179B2

(12) United States Patent
Fraser

(10) Patent No.: US 9,939,179 B2
(45) Date of Patent: Apr. 10, 2018

(54) CASCADING OIL DISTRIBUTION SYSTEM

(71) Applicant: Bruce A. Fraser, Manlius, NY (US)

(72) Inventor: Bruce A. Fraser, Manlius, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 14 days.

(21) Appl. No.: 14/962,600

(22) Filed: Dec. 8, 2015

(65) Prior Publication Data

US 2017/0159976 A1 Jun. 8, 2017

(51) Int. Cl.

| | |
|---|---|
| ***F04C 15/00*** | (2006.01) |
| ***F25B 1/04*** | (2006.01) |
| ***F25B 31/02*** | (2006.01) |

(52) U.S. Cl.

CPC ..... *F25B 1/04* (2013.01); *F25B 31/026* (2013.01)

(58) Field of Classification Search

CPC ..... F25B 1/04; F25B 31/026; F25B 31/004; F25B 2400/075; F04C 15/0088; F04C 23/001; F04C 28/02; F04C 29/12; F04C 18/0215; F04C 29/028; F04C 23/008; F04C 29/026; F04C 2240/806

USPC ..... 417/53, 62; 418/1, 83, 55.1

See application file for complete search history.

(56) References Cited

U.S. PATENT DOCUMENTS

| | | | |
|---|---|---|---|
| 4,179,248 | A | 12/1979 | Shaw |
| 4,551,989 | A | 11/1985 | Lindahl et al. |
| 4,729,228 | A | 3/1988 | Johnsen |
| 5,094,598 | A | 3/1992 | Amata et al. |
| 6,428,296 | B1 | 8/2002 | Elson et al. |
| 6,599,109 | B2 | 7/2003 | Zamudio et al. |
| 6,736,607 | B2 | 5/2004 | Ginies et al. |
| 6,983,622 | B2 | 1/2006 | DeBernardi et al. |
| 7,137,265 | B2 | 11/2006 | Kim |
| 7,316,291 | B2 | 1/2008 | Thomsen et al. |
| 7,421,850 | B2 | 9/2008 | Street et al. |
| 7,721,757 | B2 | 5/2010 | Ginies et al. |
| 8,079,830 | B2 | 12/2011 | Süss et al. |

(Continued)

FOREIGN PATENT DOCUMENTS

| | | |
|---|---|---|
| EP | 1 120 611 A1 | 8/2001 |
| JP | 042887880 A | 10/1992 |

(Continued)

*Primary Examiner* — Mohammad M Ali

(74) *Attorney, Agent, or Firm* — Reinhart Boemer Van Deuren P.C.

(57) ABSTRACT

A refrigeration system includes a plurality of compressors connected in series with each other. Each compressor has an oil sump located in a gravitational bottom of the compressor. A common supply line supplies refrigerant and oil to each of the plurality of compressors. The plurality of compressors includes a lead compressor and one or more non-lead compressors. The common supply line is configured to return more oil to the lead compressor than to the one or more non-lead compressors. Oil sump pressures for the plurality of compressors are maintained such that the lead compressor has the highest oil sump pressure, and the oil sump pressures of the non-lead compressors are successively lower with respect to its position downstream of the lead compressor. As a result, oil is distributed between adjacent compressors from the lead compressor, which is a most upstream compressor, sequentially downstream to the one or more non-lead compressors.

16 Claims, 5 Drawing Sheets

(56) References Cited

U.S. PATENT DOCUMENTS

| | | | | |
|---|---|---|---|---|
| 8,337,183 | B2 | 12/2012 | Milliff et al. | |
| 8,398,387 | B2 | 3/2013 | Shiotani et al. | |
| 9,051,934 | B2 | 6/2015 | Fraser | |
| 2001/0026766 | A1 | 10/2001 | Terai et al. | |
| 2005/0072183 | A1 | 4/2005 | Takashi | |
| 2005/0229627 | A1 | 10/2005 | DeBernardi et al. | |
| 2006/0059929 | A1 | 3/2006 | Sakitani et al. | |
| 2007/0074534 | A1 | 4/2007 | Sato | |
| 2009/0035168 | A1 | 2/2009 | Ginies et al. | |
| 2009/0041602 | A1 | 2/2009 | Ginies et al. | |
| 2009/0081062 | A1 | 3/2009 | Upadhye et al. | |
| 2009/0107173 | A1* | 4/2009 | Yoon | F25B 31/004 62/510 |
| 2009/0125257 | A1* | 5/2009 | Jayanth | F04B 35/04 702/64 |
| 2010/0092319 | A1 | 4/2010 | Duppert | |
| 2010/0186433 | A1* | 7/2010 | Galante | F04C 18/0215 62/115 |
| 2010/0186439 | A1 | 7/2010 | Ogata et al. | |
| 2010/0251736 | A1 | 10/2010 | Leweke et al. | |
| 2011/0081254 | A1 | 4/2011 | Hafkemeyer et al. | |
| 2012/0291464 | A1* | 11/2012 | Yoon | F25B 31/004 62/126 |
| 2012/0297818 | A1 | 11/2012 | Toyama et al. | |
| 2012/0304685 | A1* | 12/2012 | Kiguchi | F24F 1/26 62/468 |
| 2012/0312034 | A1* | 12/2012 | Oh | F25B 1/10 62/84 |
| 2013/0255286 | A1* | 10/2013 | Siegert | F25B 41/00 62/84 |
| 2013/0283833 | A1* | 10/2013 | Huff | F25B 1/10 62/115 |
| 2013/0330210 | A1* | 12/2013 | Bonnefoi | F04C 23/001 417/62 |
| 2014/0037483 | A1 | 2/2014 | Fraser et al. | |
| 2014/0037484 | A1* | 2/2014 | Fraser | F04C 29/028 418/1 |
| 2014/0056725 | A1* | 2/2014 | Fraser | F04C 15/0088 417/53 |
| 2014/0154105 | A1* | 6/2014 | Xu | F04B 39/0207 417/228 |
| 2015/0044070 | A1* | 2/2015 | Zhang | F25B 31/002 417/228 |

FOREIGN PATENT DOCUMENTS

| | | | |
|---|---|---|---|
| JP | 05071811 | A | 3/1993 |
| JP | H05272477 | A | 10/1993 |
| JP | 07035045 | A | 2/1995 |
| JP | H0829018 | A | 2/1996 |
| JP | H0861809 | A | 3/1996 |
| JP | 08128764 | A | 5/1996 |
| JP | 2605498 | B2 | 4/1997 |
| JP | 2001132645 | A | 5/2001 |
| JP | 2005076515 | A | 3/2005 |
| KR | 1020050065258 | A | 6/2005 |
| WO | WO 97/16647 | | 5/1997 |
| WO | WO 2005/103492 | A1 | 11/2005 |
| WO | WO 2008/081093 | A2 | 7/2008 |
| WO | WO 2010/115435 | A1 | 10/2010 |

* cited by examiner

CASCADING OIL DISTRIBUTION SYSTEM

FIELD OF THE INVENTION

This invention generally relates to multiple-compressor systems and, more particularly, to oil distribution systems used in multiple-compressor systems.

BACKGROUND OF THE INVENTION

In a multiple-compressor system, such as a refrigeration system, one challenge is to maintain sufficient oil level in each of the compressors whether the compressor is running or not. Designing a system capable of moving equal amounts of oil to different compressors is difficult due to variations in the individual compressors and piping configurations to those compressors. A particular example of the state of the art with respect to suction gas distribution in a parallel compressor assembly is represented by WIPO patent publication WO2008/081093 (Device For Suction Gas Distribution In A Parallel Compressor Assembly, And Parallel Compressor Assembly), which shows a distribution device for suction gas in systems with two or more compressors, the teachings and disclosure of which is incorporated in its entirety herein by reference thereto. A particular example of oil management in systems having multiple compressors is disclosed in U.S. Pat. No. 4,729,228 (Suction Line Flow Stream Separator For Parallel Compressor Arrangements), the teachings and disclosure of which is incorporated in its entirety herein by reference thereto.

Additionally, oil distribution systems for multiple-compressor arrangements are disclosed in U.S. Patent Pub. No. 2014/0056725, published Feb. 27, 2014; U.S. Patent Pub. No. 2014/0037483, published Feb. 6, 2014; and U.S. Patent Pub. No. 2014/0037484, published Feb. 6, 2014, each of which is assigned to the assignee of the present application. The teachings and disclosures of these publications are incorporated in their entireties herein by reference thereto.

For example, when distributing oil from one compressor to another in a refrigeration system having multiple compressors, the amount of oil distributed is at least partly dependent on the oil available to be drawn into the opening of an oil-supplying compressor such that the oil can then be distributed to one or more downstream oil-receiving compressors in the refrigeration system. It is also dependent on the oil sump pressures in the compressors.

Embodiments of the invention provide an advancement over the state of the art with respect to oil distribution in multiple-compressor systems. These and other advantages of the invention, as well as additional inventive features, will be apparent from the description of the invention provided herein.

BRIEF SUMMARY OF THE INVENTION

In one aspect, embodiments of the invention provide a refrigeration system includes a plurality of compressors connected in series with each other. Each compressor has an oil sump located in a gravitational bottom of the compressor. A common supply line supplies refrigerant and oil to each of the plurality of compressors. The plurality of compressors includes a lead compressor and one or more non-lead compressors. The common supply line is configured to return more oil to the lead compressor than to the one or more non-lead compressors. Oil sump pressures for the plurality of compressors are maintained such that the lead compressor has the highest oil sump pressure, and the oil sump pressures of the non-lead compressors are successively lower with respect to its position downstream of the lead compressor. As a result, oil is distributed between adjacent compressors from the lead compressor, which is a most upstream compressor, sequentially downstream to the one or more non-lead compressors.

In a particular embodiment, each of the plurality of compressors has an inlet supply line coupled to the common supply line. The inlet supply line for a first non-lead compressor may be configured to allow for a higher flow of oil than the inlet supply line of any non-lead compressor downstream of the non-lead compressor. In certain embodiments, the plurality of compressors includes the lead compressor, a first non-lead compressor immediately downstream of the lead compressor, a second non-lead compressor immediately downstream of the first non-lead compressor, where the inlet supply line of the first compressor is configured to allow for a higher flow of oil than the inlet supply lines for the second non-lead compressor. In this arrangement, the pressure in the inlet supply line for the lead compressor is greater than the pressure in the inlet supply line for the first non-lead compressor, which is greater than the pressure in the inlet supply line for the second non-lead compressor. This cascade of pressure drops from the lead compressor sequentially to the non-lead compressors facilitates the flow of oil from the non-lead compressor to the first and second non lead compressors, respectively.

In some embodiments, the inlet supply line for the first non-lead compressor intersects, and protrudes into, the common supply line, and the inlet supply line for the second non-lead compressor intersects, and protrudes into, the common supply farther than the inlet supply line for the first non-lead compressor.

In an alternate embodiment, the inlet supply lines for the first and second non-lead compressors both intersect, and protrude across, an entire inner diameter of the common supply line, and wherein the protruding portion of the inlet supply line for the first non-lead compressor, disposed within the common supply line, has a first opening that is larger than a second opening in the protruding portion of the inlet supply line for the second non-lead compressor, also disposed within the common supply line.

In at least one embodiment, a first oil distribution line couples the lead compressor to the first non-lead compressor in order to transfer oil from the lead compressor to the first non-lead compressor, and a second oil distribution line couples the first non-lead compressor to the second non-lead compressor in order to transfer oil from the first non-lead compressor to the second non-lead compressor. In a particular embodiment, the first and second oil distribution lines are located in a lower portion of the compressor housings for the lead, first non-lead, and second non-lead compressors.

In yet another embodiment, the inlet supply line for the lead compressor has a larger cross-sectional area than the inlet supply line for the first non-lead compressor, which, in turn, has a larger cross-sectional area than the inlet supply line for the second non-lead compressor. Each of the plurality of compressors may include at least one opening in a lower portion of its compressor housing, each of the plurality of compressors has at least one opening in a lower portion of its compressor housing, each opening configured for attachment to an oil distribution line to accommodate a flow of oil to or from the oil sump of its respective compressor. The refrigeration system may further include a third non-lead compressor immediately downstream of the second non-lead compressor, wherein the inlet supply line for the second non-lead compressor is configured to allow for a higher flow of oil than an inlet supply line for the third non-lead compressor. In this arrangement, the pressure in the inlet supply line for the lead compressor is greater than the pressure in the inlet supply line for the first non-lead compressor, which is greater than the pressure in the inlet supply line for the second non-lead compressor, which, in turn, is greater than the pressure in the inlet supply line for the third non-lead compressor. This cascade of pressure drops from the lead compressor sequentially to the non-lead compressors facilitates the flow of oil from the non-lead compressor to the first, second, and third non lead compressors, respectively.

The plurality of compressor in the aforementioned refrigeration system may include a plurality of scroll compressors. In certain embodiments of the invention, the refrigeration system includes one or more oil distribution lines connecting adjacent compressors such that oil can flow from an upstream compressor to a downstream compressor. Furthermore, each of the one or more oil flow lines may be coupled to a lower portion of each of the adjacent compressors.

In alternate embodiments of the invention, the lead compressor has a capacity that is less than the capacity of a first non-lead compressor. In particular embodiments, the first non-lead compressor has a capacity that is less than the capacity of a second non-lead compressor located downstream from the first non-lead compressor. In more particular embodiments, the lead compressor and the first non-lead compressor are scroll compressors.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following detailed description describes embodiments of the invention as applied in a multi-compressor refrigeration system. However, one of ordinary skill in the art will recognize that the invention is not necessarily limited to refrigeration systems. Embodiments of the invention may also find use in other systems where multiple compressors are used to supply a flow of compressed gas. It should also be noted that, for the sake of convenience, certain embodiments of the invention may be described hereinbelow with respect to their application in systems having multiple scroll compressors for compressing refrigerant. While particular advantages and configurations are shown for scroll compressors, Applicants submit that the scope of the invention is not necessarily limited to scroll compressors, but may find use in a variety of multiple-compressor systems using compressor types other than scroll compressors.

In the context of this application, the terms "upstream" and "downstream" are used to refer to various compressors in relation to the flow of oil between the compressors. For example, in the embodiments of refrigeration systems described hereinbelow, the lead compressor receives most of the oil in the circulated refrigerant. As such, in the embodiments presented, the lead compressor is the most upstream of the compressors. Oil flows downstream from the lead compressor to the nearest, or adjacent, non-lead compressor. If the system has a third compressor, oil flows downstream, from the aforementioned non-lead compressor nearest the lead compressor, to the next non-lead compressor.

Figure 1:
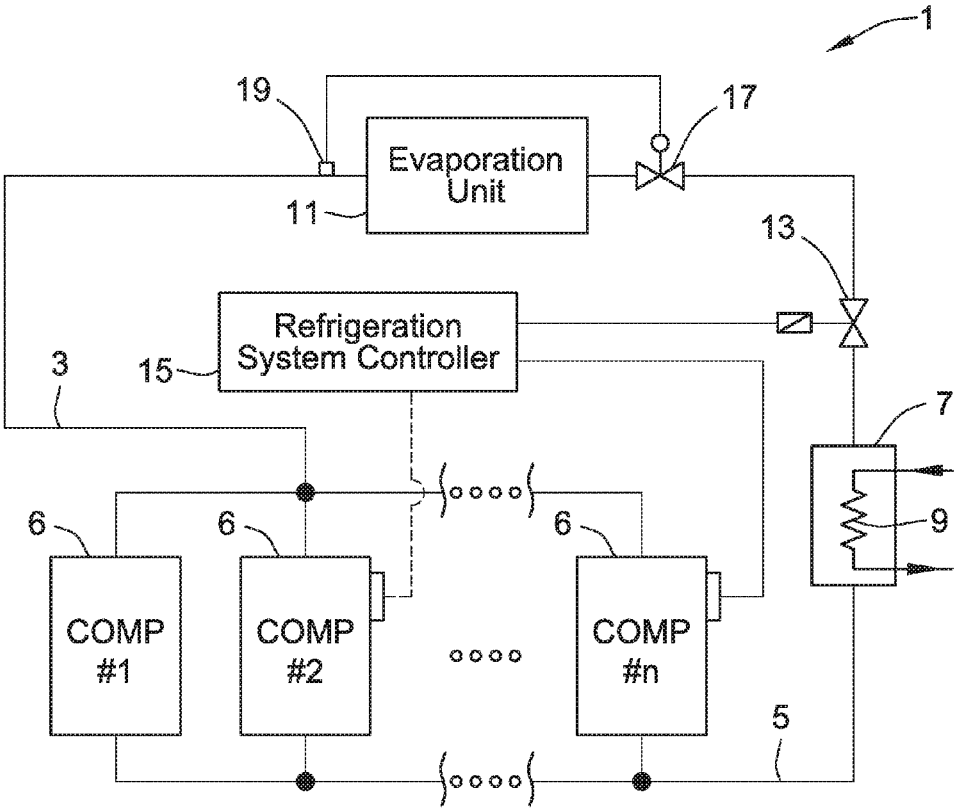
FIG. 1 is a block diagram of a multi-compressor refrigeration system, constructed in accordance with an embodiment of the invention.

FIG. 1 provides a schematic illustration of an exemplary multiple-compressor refrigeration system 1 having N compressors 6. The N compressors 6 of refrigeration system 1 are connected in a parallel circuit having inlet flow line 3 that supplies a flow of refrigerant to the N compressors 6, and outlet flow line 5 that carries compressed refrigerant away from the N compressors 6. In certain embodiments, the flow of refrigerant carries oil entrained within the flow, the oil used to lubricate moving parts of the compressor 6. As shown, the outlet flow line 5 supplies a condenser 7. In a particular embodiment, the condenser 7 includes a fluid flow heat exchanger 9 (e.g. air or a liquid coolant) which provides a flow across the condenser 7 to cool and thereby condense the compressed, high-pressure refrigerant.

An evaporation unit 11 to provide cooling is also arranged in fluid series downstream of the condenser 7. In an alternate embodiment, the condenser 7 may feed multiple evaporation units arranged in parallel. In the embodiment of FIG. 1, the evaporation unit 11 includes a shut off liquid valve 13, which, in some embodiments, is controlled by the refrigeration system controller 15 to allow for operation of the evaporation unit 11 to produce cooling when necessitated by a demand load on the refrigeration system 1, or to preclude operation of the evaporation unit 11 when there is no such demand. The refrigeration system controller 15 may also be directly connected to one or more of the N compressors 6. The evaporation unit 11 also includes an expansion valve 17 that may be responsive to, or in part controlled by, a downstream pressure of the evaporation unit 11, sensed at location 19. The expansion valve 17 is configured to control the discharge of refrigerant into the evaporation unit 11, wherein due to the evaporation, heat is absorbed to evaporate the refrigerant to a gaseous state thereby creating a cooling/refrigeration effect at the evaporation unit 11. The evaporation unit 11 returns the expanded refrigerant in a gaseous state along the inlet flow line 3 to the bank of N compressors 6.

Figure 2:
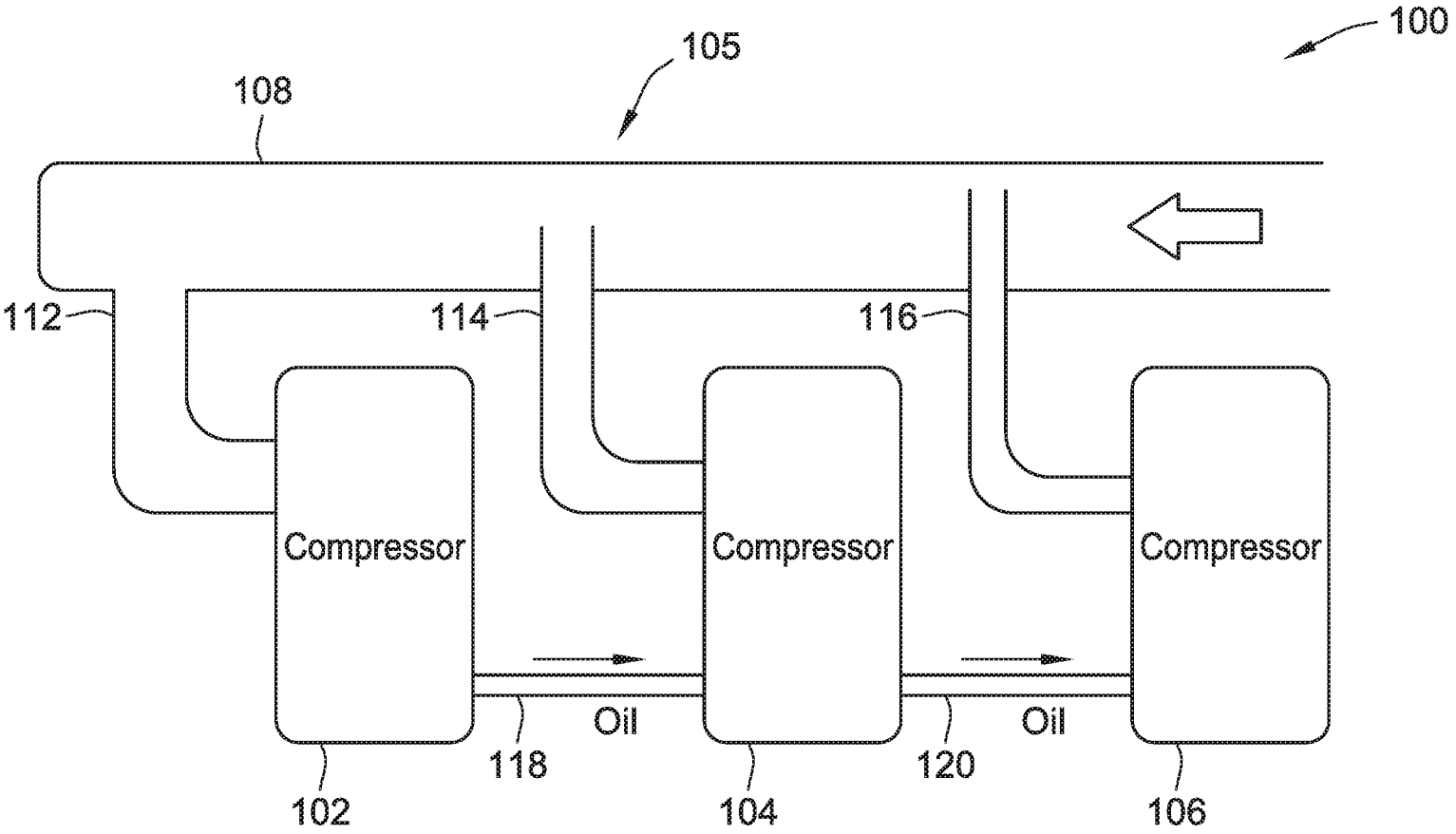
FIG. 2 is a schematic diagram of a multiple-compressor refrigeration system, constructed in accordance with an embodiment of the invention.

FIG. 2 is a schematic diagram showing a multiple-compressor refrigeration system 100, according to an embodiment of the invention. Embodiments of the present invention address some of the above-described problems related to oil distribution in multi-compressor systems by implementing a cascade-type system which distributes oil from a first compressor, having the highest oil sump pressure, to an adjacent second compressor immediately downstream of the first compressor. If the multi-compressor system includes a third compressor downstream from the second compressor, the second compressor, having an oil sump pressure higher than that of the third compressor, distributes oil downstream to the third compressor. This process is repeated for however many compressors make up the multi-compressor system. Thus, the multiple series-connected compressors distribute oil from the upstream-most compressor sequentially downstream to compressors with progressively lower oil sump pressures. In other words, the oil pressures cascade downward allowing for a flow of oil from higher-pressure compressors to lower-pressure compressors. While this design does require adjacent compressors to be running, it will be shown below that there are several different ways of achieving this cascading effect.

In the arrangements shown in FIG. 2, the refrigeration system 100 includes a lead compressor 102, a first non-lead compressor 104, and a second non-lead compressor 106. The lead compressor 102, first non-lead compressor 104, and second non-lead compressor 106 are connected in series, in that, regardless of the number of compressors in the system, oil can only flow from a compressor to the next adjacent compressor immediately downstream. The refrigeration system 100 further includes a suction header arrangement 105 that includes a common supply line 108, a lead inlet supply line 112 coupling the lead compressor 102 to the common supply line 108, a first inlet supply line 114 coupling the first non-lead compressor 104 to the common supply line 108, and a second inlet supply line 116 coupling the second non-lead compressor 106 to the common supply line 108.

In the embodiment shown, lead inlet supply line 112, the first inlet supply line 114, and the second inlet supply line 116 intersect the common supply line 108 at a gravitational bottom of the common supply line 108 where the common supply line 108 runs horizontally. While all three compressors 102, 104, 106 receive a flow of refrigerant gas, having oil entrained therein, from a common supply line 108, the common supply line 108 delivers more lubricating oil to the lead compressor 102, via the lead inlet supply line 112, which is larger than either the first or second inlet supply line 114, 116. In this context, "larger" refers to the cross-sectional area of the opening. Additionally, the first and second inlet supply lines 114, 116 are inserted beyond the inner diameter surface of the common supply line 108, causing liquid oil to flow around their insertion points and eventually enter the lead inlet supply line 112.

Much of the oil entrained in the refrigerant flow turns to oil droplets on the inner surface of the common supply line 108. More of this oil flows into the larger lead inlet supply line 112. The flow of refrigerant gas and oil is further slowed by the fact that the first and second inlet supply lines 114, 116 protrude into the common supply line 108. The second inlet supply line 116 protrudes into the common supply line 108 farther than the first inlet supply line 114 protrudes into the common supply line 108. Because the second inlet supply line 116 protrudes farther into the common supply line 108 the flow into this line is more restricted than the flow into the first inlet supply line 114.

As a result, the flow of oil into the second inlet supply line 116 to the second non-lead compressor 106 is less than that into the first inlet supply line 114 to the first non-lead compressor 104, which is less than the flow into the lead inlet supply line 112 to the lead compressor 102. The flow of refrigerant into the second non-lead compressor 106 is more restricted than the flow to the first non-lead compressor 104, which is more restricted than the flow to the lead compressor 102. Consequently, the oil sump pressure of the second non-lead compressor 106 is less than that of the first non-lead compressor 104 which, in turn, is less than the oil sump pressure in the lead compressor 102.

The relatively higher oil sump pressure in the lead compressor 102 allows for oil to be distributed from the lead compressor 102 to the first non-lead compressor via oil distribution line 118, and to be distributed from the first non-lead compressor 104 to the second non-lead compressor 106 via the second oil distribution line 120. First and second oil distribution lines 118, 120 are connected in a lower portion of each of the three compressors 102, 104, 106 so that oil can be distributed from the oil sump of one compressor to oil sump of the next downstream compressor. Thus, in the embodiments of refrigeration systems described herein, each of the series-connected compressors 102, 104, 106 has at least one opening (not shown) (the middle compressor, i.e., first non-lead compressor 104, has two openings) in a lower portion of the compressor housing for attachment to an oil distribution line to carry a flow of oil from the upstream compressor to the downstream compressor.

Figure 3:
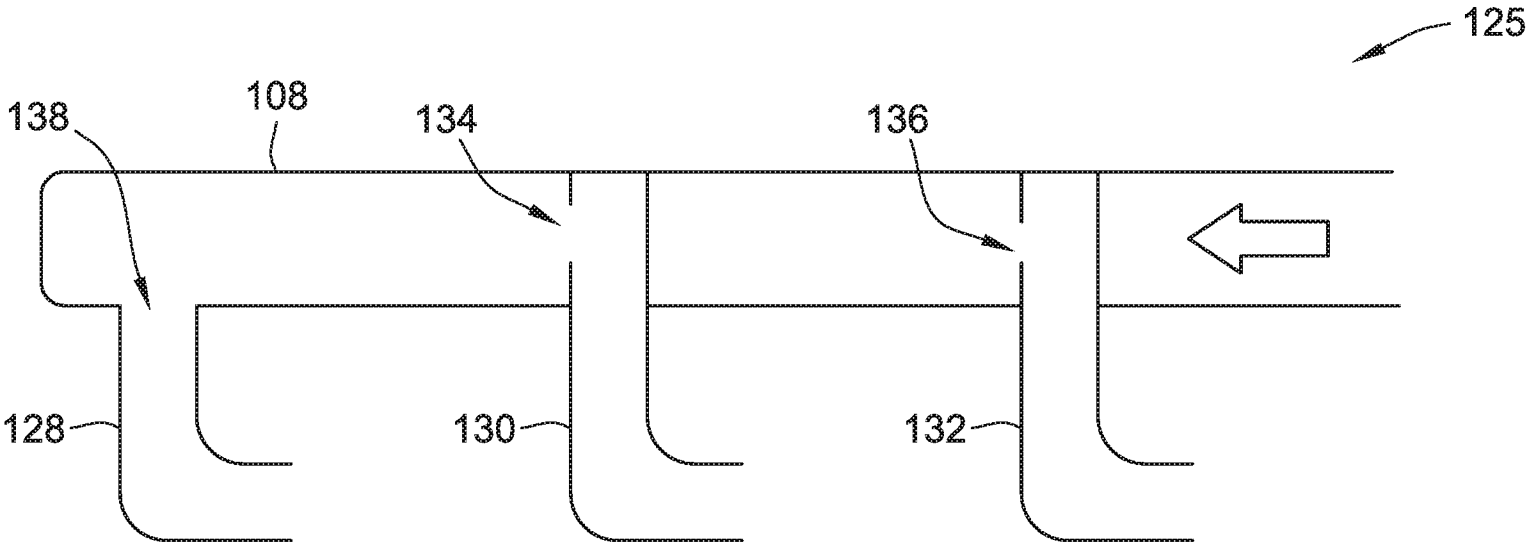
FIG. 3 is a schematic diagram of an exemplary suction header arrangement with inlet supply lines, according to an embodiment of the invention.

FIG. 3 shows an alternate embodiment of a suction header arrangement 125 including the common supply line 108, a lead inlet supply line 128, first inlet supply line 130, and a second inlet supply line 132. In the embodiment of FIG. 3, the lead inlet supply line 128, first inlet supply line 130, and second inlet supply line 132 intersect the common supply line 108 at a gravitational bottom of the common supply line 108 where the common supply line 108 runs horizontally. Both the first inlet supply line 130 and the second inlet supply line 132 protrude through the entire inner diameter of the common supply line 108. In this embodiment, the lead inlet supply line 128, first inlet supply line 130, and second inlet supply line 132 may all be the same size, though this is not required.

Because the first inlet supply line 130 and the second inlet supply line 132 protrude through the entire inner diameter of the common supply line 108, refrigerant gas and oil do not enter the first and second inlet supply lines 130, 132 through the ends, as in the embodiment of FIG. 2. Instead, a first opening 134 is created in the side of the first inlet supply lines 130, and a second opening 136 is created in the side of the second inlet supply line 132 with both openings 134, 36 disposed in a portion of the supply lines 130, 132 that is within the common supply line 108. To create the flows and cascading pressures, described in the embodiment of FIG. 2, the first opening is larger than the second opening 136, but smaller than an opening 138 of the lead input supply line 128. As explained above, the term "larger" refers to the cross-sectional area of the opening. It should also be noted that the same effect may be achieved using inlet supply lines 130, 132 of the same size, where, for example, the second inlet supply line 132 has a restriction to reduce its flow of refrigerant and oil below that of the first inlet supply lines 130, which may have no restriction or a lesser restriction.

The larger opening 138 of the lead inlet supply line 128 allows for a greater pressure of refrigerant gas and oil into the lead compressor 102 (shown in FIG. 2). The smaller opening 134 in the first inlet supply line 130 allows a lesser pressure of refrigerant gas and oil into the first non-lead compressor 104 than that flowing into the lead compressor 102. The smallest opening 136 in the second inlet supply line 132 allows the least pressure of refrigerant gas and oil to the second non-lead compressor 106. The above-described flows of refrigerant gas ensure that the lead compressor 102 has the highest oil sump pressure to facilitate the flow of oil from the lead compressor 102 to the first non-lead compressor 104. It also ensures that the first non-lead compressor 104 has a higher oil sump pressure than the second non-lead compressor 105 oil sump pressure to facilitate the flow of oil from the first non-lead compressor 104 to the second non-lead compressor 106.

Figure 4:
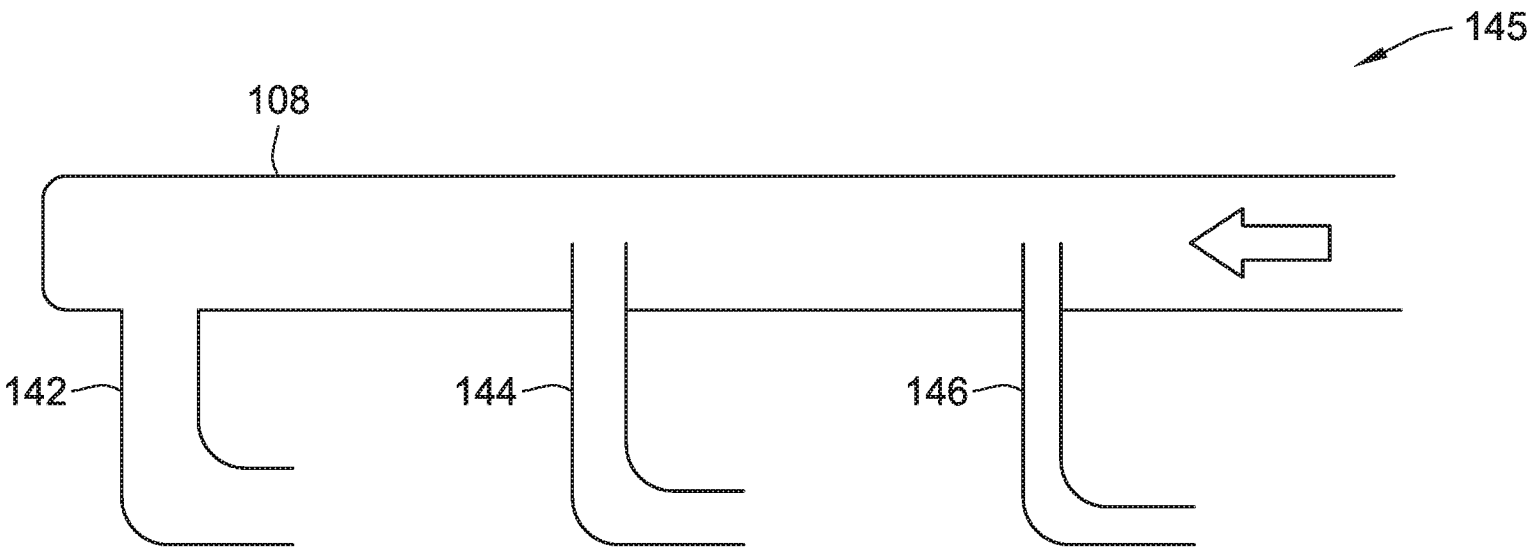
FIG. 4 is a schematic diagram of another exemplary suction header arrangement with inlet supply lines, according to an embodiment of the invention.

FIG. 4 is a schematic diagram of yet another embodiment of a suction header arrangement 145, constructed in accordance with an embodiment of the invention. In the embodiment of FIG. 4, the suction header arrangement 145 achieves the cascading pressures and oil sump pressures by controlling the size of the three inlet supply lines 142, 144, 146. The lead inlet supply line 142 is larger than the first inlet supply line 144, which is larger than the second inlet supply line 146. Consistent with its usage above, the term "larger" refers to a cross-sectional area of the inner diameter of the inlet supply line. This sizing is configured to ensure that the lead compressor 102 has the highest pressure of refrigerant gas and oil, while the first non-lead compressor 104 has a lesser pressure than the lead compressor 102, but a higher pressure than the second non-lead compressor 106.

The cascading oil sump pressures allows the lead compressor 102 to provide oil to the first non-lead compressor 104, which, in turn, provides oil to the second non-lead compressor 106. In the embodiment of FIG. 4, the first and second inlet supply lines 144, 146 protrude roughly an equal distance into the common supply line 108. However, in alternate embodiments, the first and second inlet supply lines 144, 146 protrude different distances into the common supply line 108. Adjustments to the size of the lead supply line 142 and first and second supply lines 144, 146 can achieve the desired objective regardless of how far the supply lines protrude into the common supply line 108.

Figure 5:
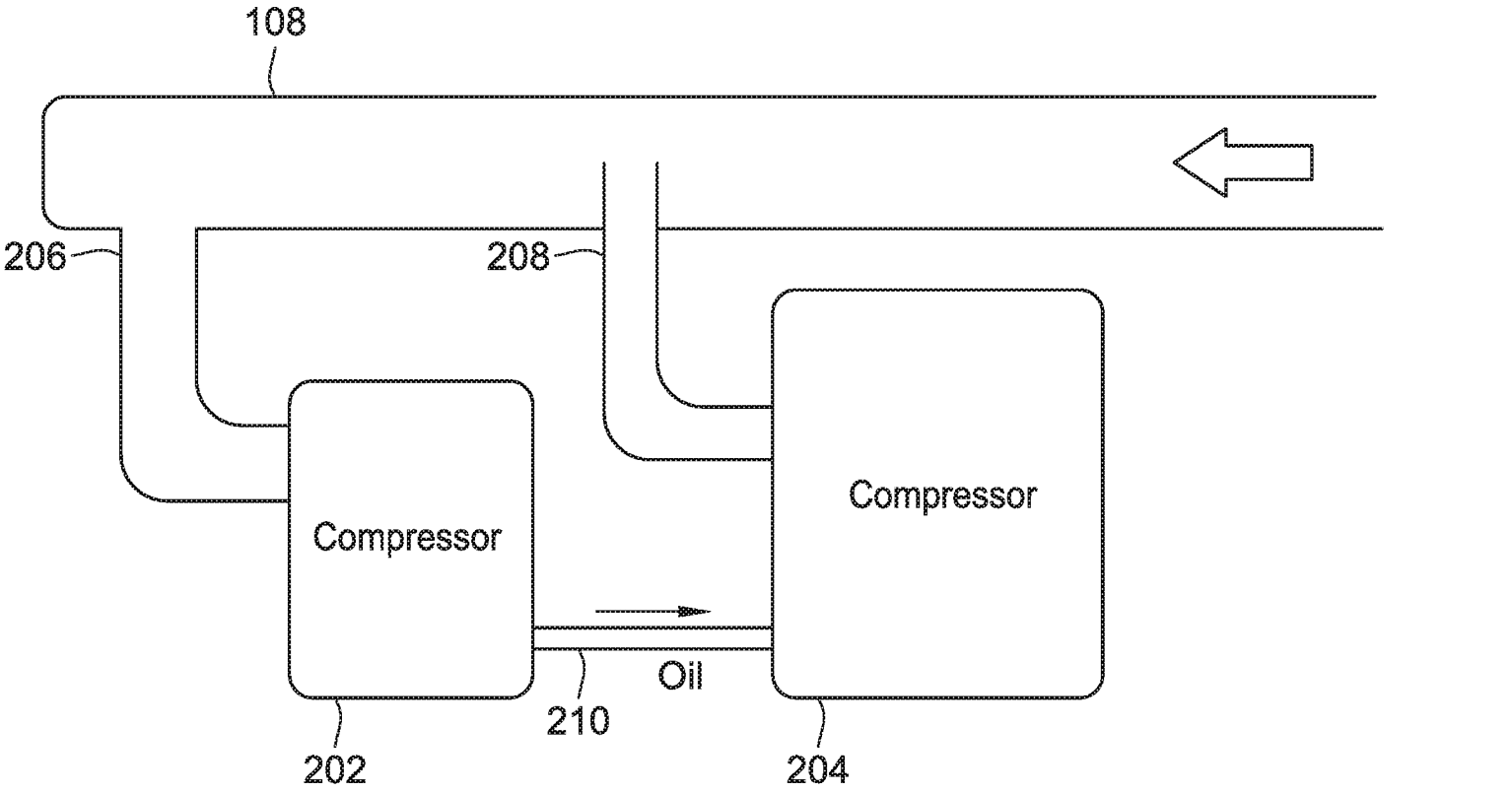
FIG. 5 is a schematic diagram of a multiple-compressor refrigeration system, constructed in accordance with an alternate embodiment of the invention.

FIG. 5 illustrates an alternate embodiment of a refrigeration system 200 in which cascading oil sump pressures facilitate the distribution of oil from compressors with relatively higher oil sump pressures to those with relatively lower oil sump pressures. The refrigeration system 200 has a lead compressor 202 coupled in series with a non-lead compressor 204. The common supply line 108 provides refrigerant gas and oil to the lead compressor 202 via a lead inlet supply line 206, and to the non-lead compressor 204 via first inlet supply line 208. In the configuration of FIG. 5, the non-lead compressor 204 compressor has a larger capacity than the lead compressor 202. For example, if the two compressors 202, 204 are scroll compressor, non-lead compressor 204 has larger scroll compressor bodies, i.e., designed to compress more refrigerant than the compressor bodies of the lead compressor, a larger drive unit, and a larger compressor housing than the lead compressor 202. Therefore, all things being equal, the larger-capacity non-lead compressor 204 would normally have a lower oil sump pressure than the lead compressor 202.

Thus, the embodiment of FIG. 5 may include lead and first inlet supply lines 206, 208 of equal size or differing size, and may include a first inlet supply line 208 that protrudes into the common supply line 108. The larger capacity and lower oil sump pressure of non-lead compressor 204 facilitates a flow of oil from the lead compressor to non-lead compressor 204 through oil distribution line 210, which is connected to lower portions of the lead and non-lead compressors 202, 204. It should also be noted that the system configuration could include a third compressor (not shown), or even more than three compressors. In some embodiments, the third compressor may have a larger capacity than the non-lead compressor 204. For example, the third compressor could be a scroll compressor with larger scroll compressor bodies, a larger drive unit, and a larger compressor housing than the non-lead compressor 204, thus creating the cascading oil sump pressures to facilitate a flow of oil from upstream to downstream compressors. However, in alternate embodiments, the third compressor has the same capacity as the non-lead compressor 204. Instead, the cascading oil sump pressures are created by differences in the inlet supply lines, as described in the embodiments above. For example the third compressor may have an inlet supply line configured for a lower pressure of refrigerant and oil than that of the inlet supply line for the non-lead compressor 204. That is, the inlet supply line for the third compressor may have a smaller cross-sectional area the inlet supply line for the non-lead compressor 204, or the inlet supply line for the third compressor may protrude farther into the common supply line 108 than the inlet supply line for the non-lead compressor 204.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A refrigeration system comprising:

a plurality of compressors connected in series with respect to oil distribution between compressors, each compressor having an oil sump located in a gravitational bottom of the compressor;

a common supply line for supplying refrigerant and oil to each of the plurality of compressors;

wherein the plurality of compressors includes a lead compressor and one or more non-lead compressors, and wherein the common supply line is configured to return more oil to the lead compressor than to the one or more non-lead compressors;

wherein oil sump pressures for the plurality of compressors are maintained such that the lead compressor has the highest oil sump pressure, and the oil sump pressures of the non-lead compressors are successively lower with respect to its position downstream of the lead compressor, such that oil is distributed between adjacent compressors from the lead compressor, which is a most upstream compressor, sequentially downstream to the one or more non-lead compressors.

2. The refrigeration system of claim 1, wherein each of the plurality of compressors has an inlet supply line coupled to the common supply line.

3. The refrigeration system of claim 2, wherein the inlet supply line for a first non-lead compressor is configured to allow for a higher pressure than the inlet supply line of any non-lead compressor downstream of the first non-lead compressor.

4. The refrigeration system of claim 3, wherein the plurality of compressors includes the lead compressor, a first non-lead compressor immediately downstream of the lead compressor, a second non-lead compressor immediately downstream of the first non-lead compressor, and wherein the inlet supply line of the first non-lead compressor is configured to allow for a higher pressure than the inlet supply lines for the second non-lead compressor.

5. The refrigeration system of claim 4, wherein the inlet supply line for the first non-lead compressor intersects, and protrudes into, the common supply line, and wherein the inlet supply line for the second non-lead compressor intersects, and protrudes into, the common supply farther than the inlet supply line for the first non-lead compressor.

6. The refrigeration system of claim 4, wherein the inlet supply lines for the first and second non-lead compressors both intersect and protrude across an entire inner diameter of the common supply line, and wherein the protruding portion of the inlet supply line for the first non-lead compressor has a first opening that is larger than a second opening in the protruding portion of the inlet supply line for the second non-lead compressor.

7. The refrigeration system of claim 4, wherein a first oil distribution line couples the lead compressor to the first non-lead compressor in order to transfer oil from the lead compressor to the first non-lead compressor, and wherein a second oil distribution line couples the first non-lead compressor to the second non-lead compressor in order to transfer oil from the first non-lead compressor to the second non-lead compressor.

8. The refrigeration system of claim 4, wherein the inlet supply line for the lead compressor has a larger cross-sectional area than the inlet supply line for the first non-lead compressor, which has a larger cross-sectional area than the inlet supply line for the second non-lead compressor.

9. The refrigeration system of claim 4, further comprising a third non-lead compressor immediately downstream of the second non-lead compressor, wherein the inlet supply line for the second non-lead compressor is configured to allow for a higher pressure than an inlet supply line for the third non-lead compressor.

10. The refrigeration system of claim 1, wherein each of the plurality of compressors has at least one opening in a lower portion of its compressor housing, each opening configured for attachment to an oil distribution line to accommodate a flow of oil to or from the oil sump of its respective compressor.

11. The refrigeration system of claim 1, wherein the plurality of compressors comprises a plurality of scroll compressors.

12. The refrigeration system of claim 1, further comprising one or more oil distribution lines, each oil distribution line connecting adjacent compressors such that oil can flow from an upstream compressor to a downstream compressor.

13. The refrigeration system of claim 1, wherein each of the one or more oil distribution lines is couple to a lower portion of each of the adjacent compressors.

14. The refrigeration system of claim 1, wherein the lead compressor has a capacity that is less than the capacity of a first non-lead compressor.

15. The refrigeration system of claim 14, wherein the lead compressor and the first non-lead compressor are scroll compressors.

16. The refrigeration system of claim 14, wherein the first non-lead compressor has a capacity that is less than the capacity of a second non-lead compressor located downstream from the first non-lead compressor.

* * * * *